US007461487B2

(12) United States Patent
Greenberg et al.

(10) Patent No.: US 7,461,487 B2
(45) Date of Patent: Dec. 9, 2008

(54) LINTEL SUPPORTED MASONRY WALL SYSTEM WITH TENSIONING RODS

(76) Inventors: Harold H. Greenberg, 501 Happy Valley Rd., Prescott, AZ (US) 86301; Richard C. Campbell, Jr., 11638 N. Ribbonwood Dr., Oro Valley, AZ (US) 85737

( * ) Notice: Subject to any disclaimer, the term of this patent is extended or adjusted under 35 U.S.C. 154(b) by 0 days.

(21) Appl. No.: 11/458,299

(22) Filed: Jul. 18, 2006

(65) Prior Publication Data

US 2006/0265982 A1 Nov. 30, 2006

Related U.S. Application Data

(62) Division of application No. 10/695,233, filed on Oct. 28, 2003.

(51) Int. Cl.
*E02D 27/00* (2006.01)

(52) U.S. Cl. ..... 52/293.2; 52/293.3

(58) Field of Classification Search ..... 256/19, 256/73, 65.14; 52/649.1, 649.2, 587.1, 293.2, 52/293.3, 263, 169.9
See application file for complete search history.

(56) References Cited

U.S. PATENT DOCUMENTS 957,048 A 5/1910 Francis
2,815,656 A 12/1957 Klein et al.
3,537,220 A 11/1970 Ellis
4,064,668 A 12/1977 Carter ..... 52/295
4,353,194 A 10/1982 Norton ..... 52/742
4,726,567 A 2/1988 Greenberg ..... 256/19
4,750,306 A 6/1988 Granieri ..... 52/251
4,821,483 A 4/1989 Adams ..... 52/747
5,007,218 A 4/1991 Bengtson et al. ..... 52/204
5,623,797 A * 4/1997 Gravier et al. ..... 52/284
5,794,921 A * 8/1998 Greenberg ..... 256/19
5,864,999 A * 2/1999 Wallin ..... 52/293.1
6,431,979 B1 * 8/2002 Asbjornson et al. ..... 454/233
6,560,938 B1 * 5/2003 Powers, Jr. ..... 52/204.2
6,564,524 B1 * 5/2003 Gruita ..... 52/604
6,571,521 B1 6/2003 Ameigh ..... 52/295
6,632,048 B2 10/2003 Greenberg ..... 405/284
6,735,913 B2 * 5/2004 Sanders et al. ..... 52/284
2002/0166302 A1 11/2002 Ogorchock ..... 52/294
2003/0009970 A1 * 1/2003 MacDonald et al. ..... 52/562

* cited by examiner

*Primary Examiner*—Richard E Chilcot, Jr.
*Assistant Examiner*—Jessica Laux
(74) *Attorney, Agent, or Firm*—Cahill, von Hellens & Glazer

(57) ABSTRACT

A wall system or structure includes a lintel supported wall and footings for locating the lintel above ground. Tensioning rods extend upwardly from each footing for directly engaging an end of the wall and for securing a post to the footing, which post includes a slot for engaging the vertical edge of the wall. A plate resting on each footing may be used to support an end of the lintel above ground. Tensioning rods extend vertically from within the lintel upwardly into the wall.

3 Claims, 3 Drawing Sheets

LINTEL SUPPORTED MASONRY WALL SYSTEM WITH TENSIONING RODS

CROSS REFERENCE TO RELATED APPLICATIONS

This application is a divisional application of an application entitled "LINTEL SUPPORTED MASONRY WALL SYSTEM AND METHOD" filed Oct. 28, 2003 and assigned Ser. No. 10/695,233, disclosing an invention made by the present inventors.

BACKGROUND OF THE INVENTION

1. Field of the Invention

The present invention relates to a masonry wall system and, more particularly, to an above ground lentil supported masonry wall having post tensioning elements.

2. Description of Related Art

The use of masonry walls is well known in the prior art. The significant pressures exerted by heaving soil due to freezing and melting of water requires prior art masonry walls to incorporate a significant amount of steel in the form of reinforcing bars extending through the voids or cells in the masonry block and into a foundation or a footer. A variety of other techniques have also been used in the prior art in an attempt to strengthen the wall and to provide sufficient resistance to the pressure caused by the soil pressing against the bottom of the wall; these techniques are usually complicated and are always expensive. Some prior art techniques have incorporated post tensioning rods wherein courses of block have been compressed with respect to each other and the compressed courses are then secured in some manner to a foundation. These latter techniques usually require expensive installation provisions for appropriately supporting the compressed courses on the designated foundation or footing.

SUMMARY OF THE INVENTION

The present invention incorporates a masonry wall structure that utilizes a foundation or footing for supporting a lentil upon which the courses of masonry block are built. Post tensioning rods are imbedded in concrete within the lentil and extend upwardly essentially vertically from the lentil. A plurality of courses of masonry block are then placed on the lentil with the respective post tensioning rods extending through the cells therein and beyond the next to the top course of the masonry blocks. Clamping plates extend across the cells of selected masonry blocks in the next to the top course of blocks and include an opening therein to permit the passage of the threaded end of a respective post tensioning rod. The end of each of the post tensioning rods receive a nut which is placed on the rod and threaded to engage the clamping plate and a predetermined tension is placed on the respective post tensioning rod. A top course of masonry blocks is laid with the cells therein receiving the threaded rod ends engaging the nuts and the cells are filled with grout. A column or post of H-shaped blocks defining slots on opposed sides and having an internal vertical space extends upwardly from a corresponding foundation or footing. Alternatively, such a post may be constructed of other blocks, bricks, etc. to define the slots and the vertical space. Post tensioning rods extend from within the footing upwardly through the center cells of the H blocks and is secured to the top of the post by a nut bearing against a clamping plate to post tension each post. For cost reasons or other considerations, rebar extending from the footing and grouted within the vertical space may be used in place of the tensioning rods. The lintel and lintel supported wall extend from within the laterally oriented slots in opposing relationship of adjacent posts. If the footing is at ground level, a starter course of masonry or plate is placed thereon to support the lintel above ground and the post extends upwardly therefrom. In an alternate embodiment, each lintel supported wall rests upon the footing or upon a plate on the footing and a post tensioning rod extends from within the footing upwardly through the end of the wall and is secured by a nut and clamping plate.

A primary object of the present invention is to provide an above ground block or brick wall.

Another object of the present invention is to provide an above ground lintel for supporting a block or brick wall between adjacent posts.

Still another object of the present invention is to provide an above ground lintel supported block or brick wall having tensioning rods extending upwardly from within the lintel.

Yet another object of the present invention is to provide a lintel supported block or brick wall disposed between posts constructed of H blocks and nesting within the opposing slots of adjacent posts that accommodate vertical movement of the lintel supported wall.

A further object of the present invention is to provide a lintel supported block or brick wall secured to a footing at opposed ends by tension rods extending from within the footing and upwardly through a significant height of the wall.

A still further object of the present invention is to provide a plurality of lintel supported wall sections each end of which is supported by a footing to locate the lintel above ground.

A yet further object of the present invention is to provide a method for constructing an above ground block or brick wall supported at the opposed ends by a footing and in slidable engagement with slots disposed in columns extending from the footings.

A yet further object of the present invention is to provide a method for providing post tensioning rods to anchor a lintel supported block or brick wall above ground.

A yet further object of the present invention is to provide a lintel supported wall attached to a footing at each opposed end by post tensioning rods.

These and other objects of the present invention will become apparent to those skilled in the art as the description of the invention proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
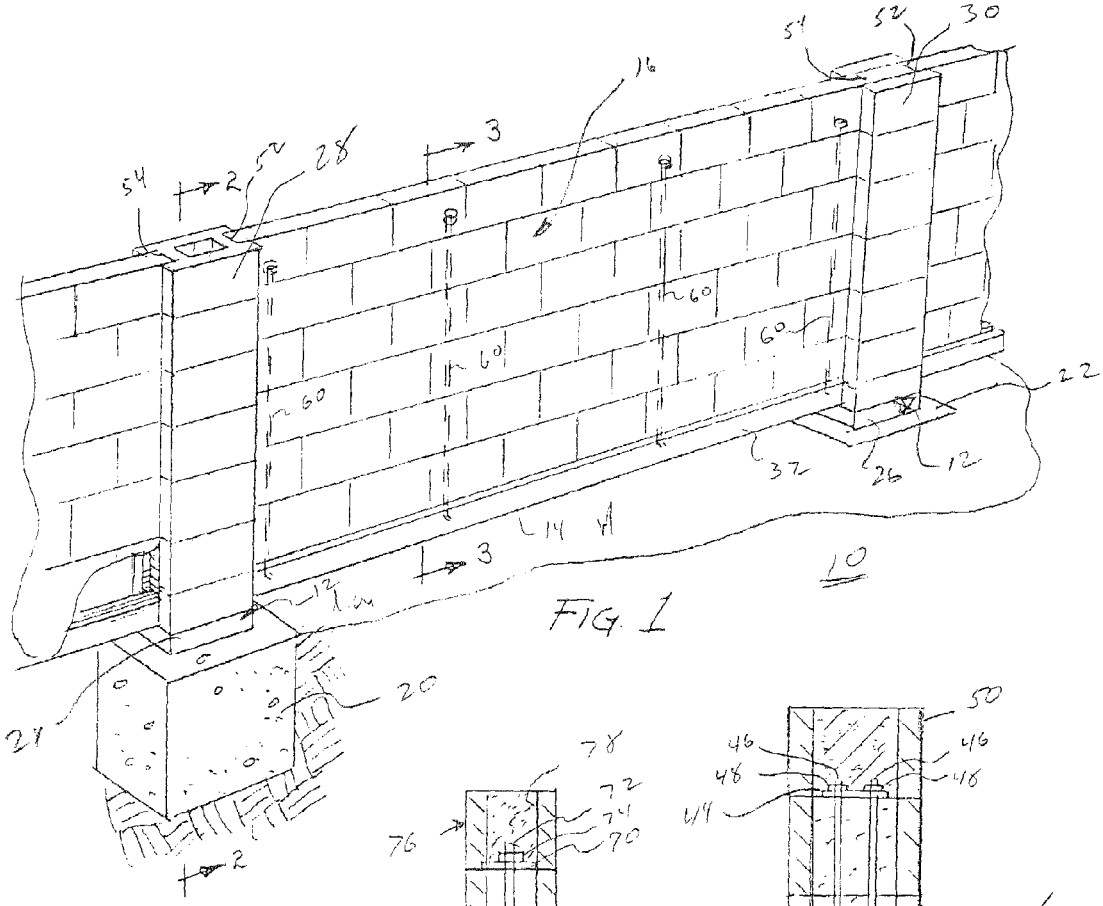
FIG. 1 is a perspective view of a lintel supported block or brick wall system.
Figure 4:
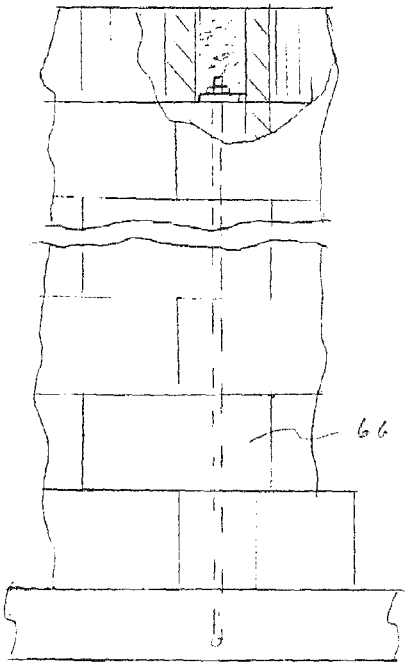
FIG. 4 is a partial view of the wall and the upper end of a post tensioning rod.

Referring to FIG. 1, there is illustrated an above ground block or brick wall system 10. The wall system or structure provides walls supported by post assemblies 12 at each end of each wall section, which post assemblies support bottom edge 14 of wall 16 above ground at a predetermined height. Such above ground support accommodates heaving of the ground due to freezing, melting permafrost, flooding and other phenomena that may occur. Moreover, the growth of roots of trees planted close to wall 16 will have little, if any, tendency to raise and crack a section of the wall.

Below ground foundations or footings 20, 22 support plates 24, 26 upon which posts 28, 30, respectively, are built. Preferably, these posts are of blocks known as H blocks and are commercially available from various sources. The posts also may be columns built in the conventional manner to provide vertical slots on opposed sides and a vertical space extending therethrough. A lintel 32 is supported by plates 24, 26 and nests within vertical slots 52, 54 formed in each of posts 28, 30. A plurality of courses of blocks are built upon the lintel and also extend into the slots of the posts. As illustrated, wall 16 may include post tensioning rods to greatly enhance the structural strength of the wall.

Figure 2:
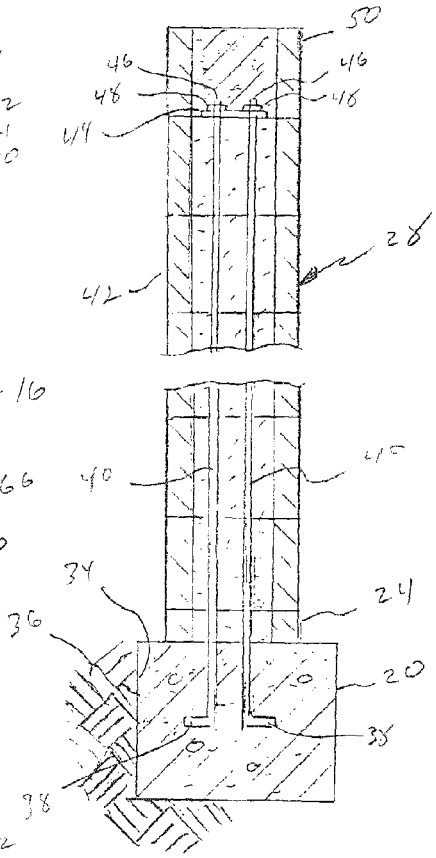
FIG. 2 is a cross sectional view taken along lines 2-2, as shown in FIG. 1.
Figure 5:
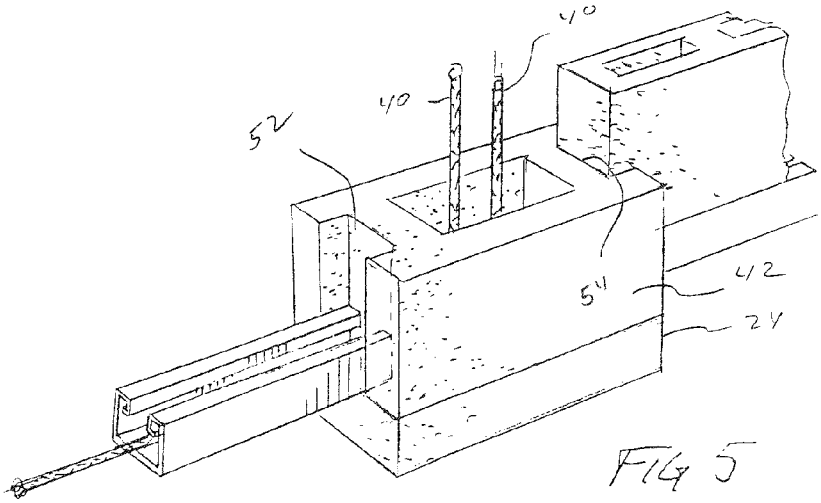
FIG. 5 illustrates the bottom block of a wall supporting post.

Referring jointly to FIGS. 2 and 5, details of post 28 will be described. As footing 20 is poured into a pre-excavated hole 34 in ground 36, lower ends 38 of a pair of tensioning rods 40 are placed therein to extend upwardly essentially vertically. After curing of footing 20, apertured plate 24 is placed thereupon with tensioning rods 40 extending through the aperture; plates of this type are commercially available; these plates may also be referred to as a starter course of masonry blocks. Thereafter, a plurality of commercially available H blocks 42 are laid in the conventional manner to form post 28. The center cell of the H block is filled with grout to encapsulate tensioning rods 40 except for the threaded upper ends thereof extending above the next to the top H block. A clamping plate or plates 44 is brought into penetrable engagement with threaded ends 46 of the tensioning rods and nuts 48 are brought into threaded engagement with the ends to bear against the clamping plate and thereby place tensioning rods 40 in tension to greatly enhance the strength and robustness of posts 28/30. A top H block 50 is laid and the center cell may be filled in the conventional manner. As particularly shown in FIG. 5, posts 28/30 define a pair of opposed vertically extending slots 52, 54. For cost and/or engineering considerations, conventional rebars or rods extending from within the footing into the posts and grouted may be used in place of the tensioning rods.

Figure 3:
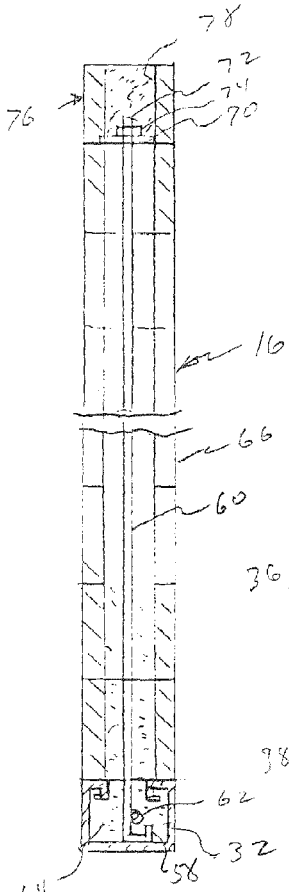
FIG. 3 is a cross sectional view taken along lines 3-3, as shown in FIG. 1.
Figure 6:
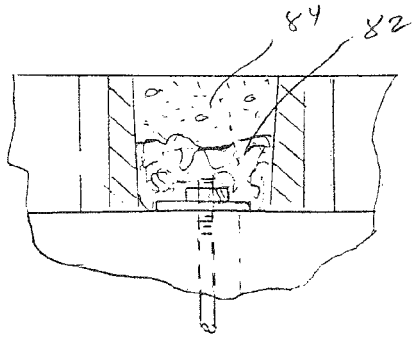
FIG. 6 illustrates a method for filling the cells in the top course of the wall.
Figure 8:
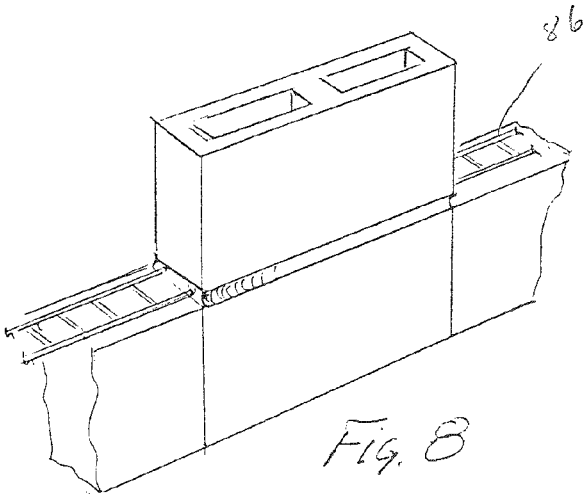
FIG. 8 illustrates the ladder wire between courses of the wall.
Figure 7:
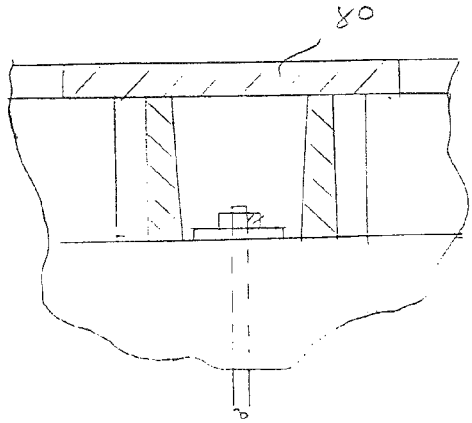
FIG. 7 illustrates slabs above the cells of the top course of the wall.
Figure 9:
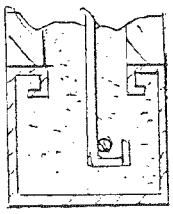
FIG. 9 is a cross sectional view of the concrete filled lintel.

Referring jointly to FIGS. 3, 4, 5 and 9, the structure and construction of wall 16 will be described. Lintel 32 is known in the trade as a galvanized box lintel; a particularly suitable version is sold by Power Steel and Wire, Inc.. This lintel is, in cross section, like the letter C lying on its back with the ends folded back upon themselves, as illustrated in FIGS. 3 and 9. After the lintel is placed upon plates 24, 26 of posts 28, 30 within slots 52, 54 (see FIG. 1), lower ends 58 of tensioning rods 60 are placed within the lintel. Ends 58 of the tensioning rods may be bent back upon themselves, as illustrated, to receive one or more longitudinally extending rebars 62. Thereafter, lintel 32 is filled with grout in the conventional manner to encapsulate ends 58 of the tensioning rods and any rebars 62 placed therein. During curing of the grout, the tensioning rods are maintained essentially vertical. Furthermore, the longitudinal placing of the tensioning rods along the lintel is dimensioned to coincide with the voids or cells in the blocks forming the courses of wall 16. After curing of grout 64 within lintel 32, courses of concrete masonry units (CMU) are laid in the conventional manner. Each of the courses extends into slots 52, 54 of posts 28, 30. After all but the top course of CMU's or blocks 66 have been laid, a clamping plate 70 is laid thereon in penetrable engagement with threaded end 72 of each tensioning rod 60. Thereafter, a nut 74 is threadedly engaged with the end and bears against the clamping plate to bring the tensioning rod into tension. Top course 76 is then laid in the conventional manner. Cells 78 therein may be covered by a plurality of plates 80, as shown in FIG. 7. Alternatively, paper 82 may be placed within each cell not having a plate associated therewith to serve in the manner of a dam, as shown in FIG. 6, and grout 84 is placed thereabove and even with the top of top course 76. Other conventional methods for closing any open cells may be employed. As illustrated in FIG. 8, a wire ladder 86 may be placed on top of each course, as is conventional to further add to the robustness and structural strength of wall 16. Bricks of conventional material which have passageways extending therethrough are commercially available; it is to be understood that such bricks could be used in place of the CMU's for each course or for certain of the courses. Blocks of other materials, including man made materials, meeting engineering and cost constraints could also be used.

Figure 10:
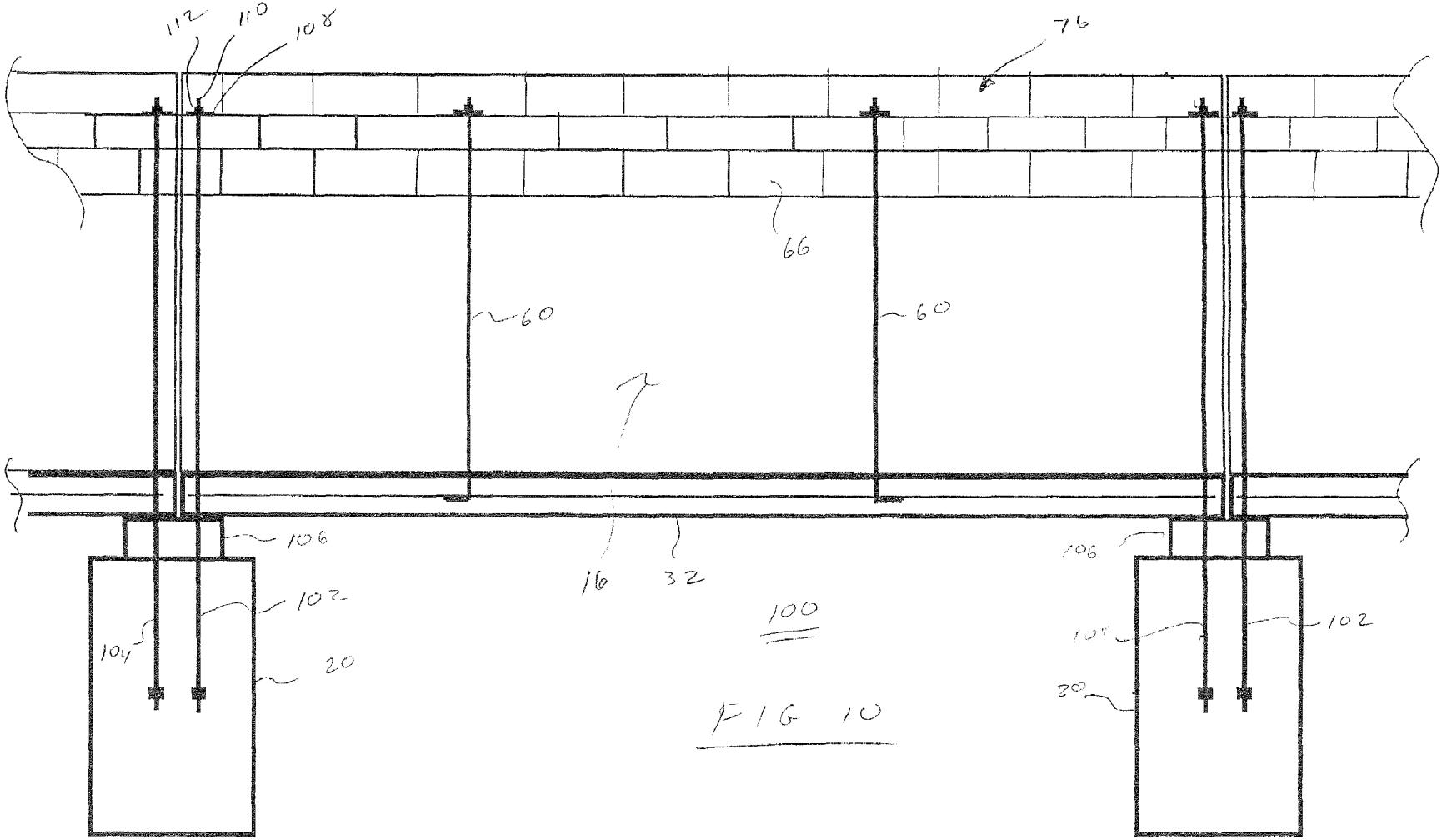
FIG. 10 illustrates a variant structure for supporting the end of a block or brick wall on a footing.

Referring to FIG. 10 there is illustrated an alternate wall system 100 embodying wall 16 and supporting same. Footings 20 are poured in the conventional manner. Before the footings set, tensioning rods 102, 104, spaced apart from one another, are set and extend vertically upwardly. After the footings cure, a starter course of masonry block(s) or plates 106 are mounted thereon with the tensioning rods extending through passageways therein.

Wall 16 is built as set forth above. That is, lintel 32 is laid upon plates 106 and tensioning rods 60 set in grout therein and extend upwardly therefrom. Furthermore, tensioning rods 102, 104 extend through the aperture or opening in the lintel. Thereafter, blocks 66 are laid in the conventional manner with tension rods 60 and 102, 104 extending therethrough. Each of these tensioning rods is anchored by a clamping plate in penetrable engagement with the respective threaded end 1 10. A nut 112 is brought into threaded engagement with each threaded end for placing the respective tensioning rod in tension. Top course 76 is added in the conventional manner.

By inspection of FIG. 10, it will be evident that posts 28, 30 illustrated in FIG. 1 are not used. Instead, tensioning rods 102, 104 serve the purpose of anchoring each end of wall 16 to its respective footing 20. Furthermore, plates 106 maintain lintel 32 above ground.

By using both tensioning rods 60 within wall 60 and tensioning rods 102, 104 at the respective ends of the wall, the wall is maintained in significant compression. Such compression adds very measurably to the structural rigidity and robustness of the wall. Furthermore, tensioning rods 102, 104 are a significant factor to resist tilting of the wall due to externally imposed forces. As tensioning rods 102, 104 serve the function of posts 28, 30 (see FIG. 1), they permit elimination of the material and labor costs attendant such posts for a considerable overall savings in the building of wall structure or system 100.

Where the strength resulting from use of tensioning rods is not necessary, rebars or like rods could be used as substitutes for the tensioning rods in the embodiments described above.

The robustness of wall 60 has a further subtle, but important attribute. When the ground heaves to an extent sufficient to contact the underside of lintel 32, forces are imposed on the lintel and the wall extending upwardly therefrom. These forces may be sufficient to stress the wall sufficiently to compromise its integrity unless the stresses are relieved. As is evident from the above description, wall 60 is located with opposed slots of the posts but it is not mechanically attached to the slots. Accordingly, the wall can rise within the slots in the posts at opposed ends upon an application of a lifting force on the lintel. Thereby, the stresses due to heaving of the ground sufficient to contact the lintel can and are relieved by a resulting upward sliding of the wall and the integrity of the wall structure will not be compromised.

We claim:

1. A wall structure having an above ground wall, said wall structure comprising in combination:

a) a plurality of footings disposed at least partially in the ground;

b) said wall including a box lintel, said box lintel being supported at each end by adjacent ones of said footings and a plurality of courses extending upwardly from said lintel;

c) at least one tensioning rod extending upwardly from said box lintel into said wall;

d) said at least one tensioning rod having a lower end bent at least laterally with regard to the longitudinal axis of said tensioning rod and disposed within said box lintel;

e) at least one length of rebar extending longitudinally within said box lintel in proximity to and above each lower end of said at least one tensioning rod;

f) grout disposed within said box lintel for imbedding said rebar and said lower end of said at least one tensioning rod; and g) at least one further tensioning rod extending upwardly from within each footing of said plurality of footings and adapted for resisting tilting of said wall, each of said further tensioning rods including a lower end bent laterally from said further tensioning rod.

2. The wall structure as set forth in claim 1 wherein said at least one further tensioning rod extends upwardly within said wall at one end thereof.

3. The wall structure as set forth in claim 1 wherein said lower end is bent back upon itself.

* * * * *